US009979117B2

(12) United States Patent
Chen et al.

(10) Patent No.: US 9,979,117 B2
(45) Date of Patent: May 22, 2018

(54) CONNECTOR HAVING WATERPROOF FUNCTION AND ELECTRONIC DEVICE USING SAME

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Chi-Chun Chen, New Taipei (TW); Xiao-Yu Liu, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 906 days.

(21) Appl. No.: 14/499,263

(22) Filed: Sep. 29, 2014

(65) Prior Publication Data

US 2015/0092325 A1 Apr. 2, 2015

(30) Foreign Application Priority Data

Sep. 30, 2013 (CN) ..... 2013 1 0457695

(51) Int. Cl.
*H01R 13/46* (2006.01)
*H01R 13/52* (2006.01)
*H01R 13/74* (2006.01)

(52) U.S. Cl.
CPC ..... *H01R 13/5202* (2013.01); *H01R 13/74* (2013.01)

(58) Field of Classification Search
CPC .... H01R 13/5202; H01R 13/74; H01R 13/46; H01R 13/741; H01R 13/745; H01R 9/03; H01R 9/00; H02G 15/00; H02G 15/013; H02G 15/02; H02G 15/04
USPC ... 174/17 CT, 650, 653, 655, 656, 659, 660, 174/665, 668, 669, 520; 439/535, 271, 439/274, 275; 16/2.1, 2.2; 248/56, 68.1
See application file for complete search history.

(56) References Cited

U.S. PATENT DOCUMENTS 5,072,072 A * 12/1991 Bawa ..... H02G 3/0691 174/655
6,043,432 A * 3/2000 Gretz ..... H02G 3/0691 174/167
6,737,584 B2 * 5/2004 Kiely ..... H02G 3/0691 248/56

(Continued)

*Primary Examiner* — Angel R Estrada
(74) *Attorney, Agent, or Firm* — ScienBiziP, P.C.

(57) ABSTRACT

A connector is fixed in an opening of a housing of an electronic device. The connector comprises a main body housed in the opening, a gasket and a securing member. The main body comprises a plug portion, and an engaging portion connecting the plug portion. Furthermore, an engaging groove located on the engaging portion adjacent to the plug portion. The gasket located between the between the plug portion and the housing. The engaging portion sequentially passes through the gasket and the opening to make a part of the engaging groove away from the plug portion is located a side of the housing. The securing member partly engaged in the engaging groove and sandwiched between the engaging portion and the housing to fix the main body to the housing.

18 Claims, 7 Drawing Sheets

(56) References Cited

U.S. PATENT DOCUMENTS

| | | | | |
|---|---|---|---|---|
| 6,860,758 | B1 * | 3/2005 | Kiely | H01R 4/363 174/652 |
| 6,957,968 | B1 * | 10/2005 | Gretz | H02G 3/0666 174/661 |
| 7,060,900 | B1 * | 6/2006 | Gretz | H02G 3/06 174/152 G |
| 7,963,811 | B2 * | 6/2011 | Wason | H01R 9/2483 439/778 |
| 8,350,163 | B2 * | 1/2013 | Auray | H02G 3/0691 174/650 |

* cited by examiner

CONNECTOR HAVING WATERPROOF FUNCTION AND ELECTRONIC DEVICE USING SAME

CROSS-REFERENCE TO RELATED APPLICATIONS

This application claims priority to Chinese Patent Application No. 201310457695.1 filed on Sep. 30, 2013, the contents of which are incorporated by reference herein.

FIELD

The subject matter herein generally relates to connectors, and particularly to a connector having waterproof function and an electronic device using the same.

BACKGROUND

An electronic device may include a housing and several connectors, such as an earphone jack or a Universal Serial Bus (USB) port, fixed in an opening of the housing. A gap between the opening of the housing and the connector may occur with the connector being inserted into the opening or pulled out from the opening by external force.

BRIEF DESCRIPTION OF THE FIGURES

Implementations of the present disclosure will now be described, by way of example only, with reference to the attached figures, wherein.

DETAILED DESCRIPTION

Figure 1:
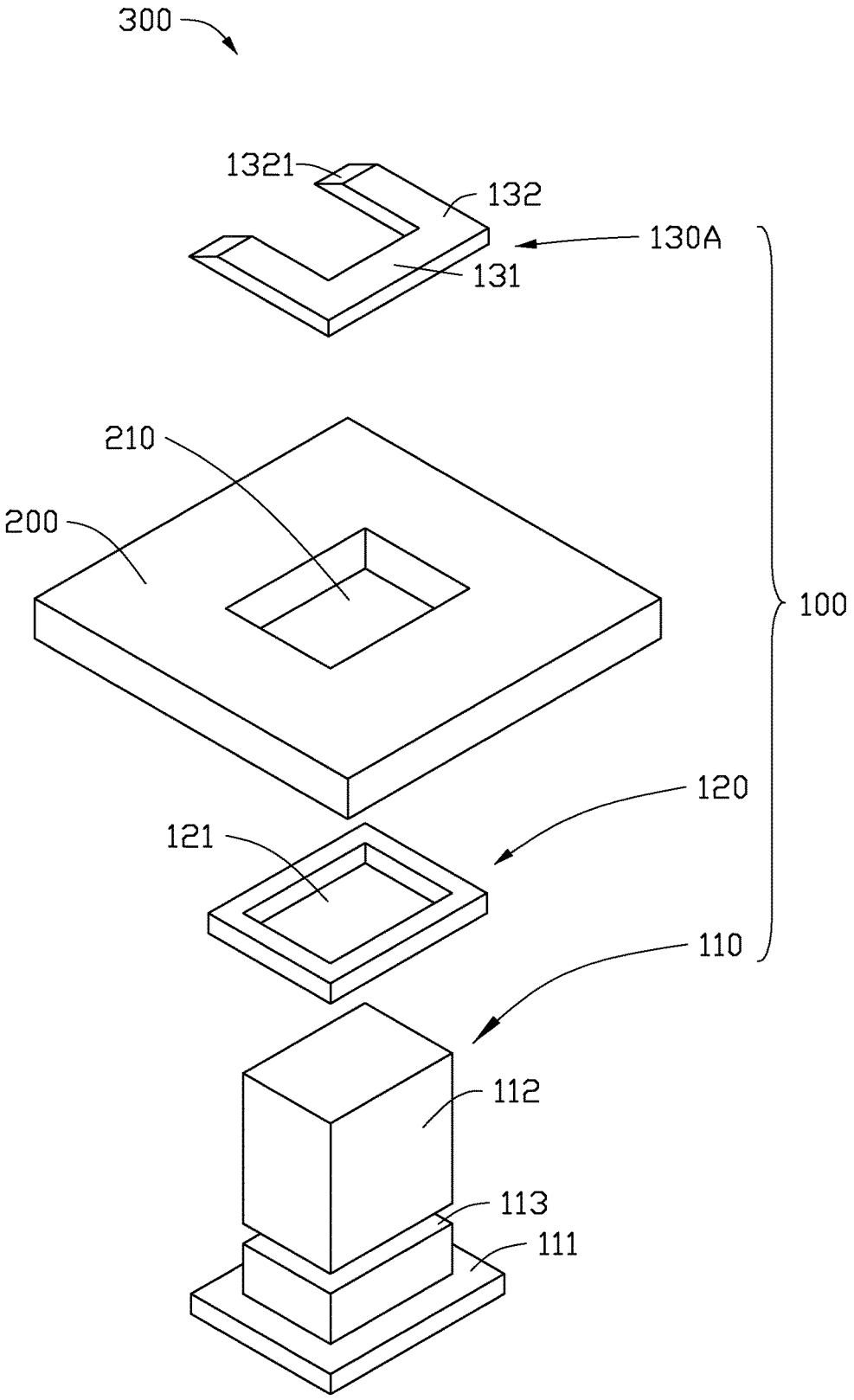
FIG. 1 is an exploded isometric view of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is in relation to a connector having waterproof function and an electronic device using the same.

FIG. 1 illustrates an embodiment of an electronic device 300. The electronic device 300 includes a connector 100 and a housing 200. The housing 200 in the FIG. 1 is a part of the whole housing of the electronic device 300, such as a sidewall of the electronic device 300. The housing 200 is configured for fixing the connector 100 and receiving other electronic components (not shown) of the electronic device 300. Further, an opening 210 is defined on the housing 200 for receiving the connector 100. In the embodiment, the electronic device 300 is a mobile phone. The connector 100 can be an earphone jack or a Universal Serial Bus (USB) port. In other embodiments, the electronic device 300 may be a tablet computer, a camera, or the like.

The connector 100 includes a main body 110, a gasket 120 and a securing member 130A. The main body 110 includes a plug portion 111 and an engaging portion 112 connecting the plug portion 111. The plug portion 111 is configured for being plugged by a device, such as an earphone, a data cable or the like. The engaging portion 112 is substantially cuboid-shaped and perpendicularly extending from the center of the plug portion 111. An engaging groove 113 is located on the engaging portion 112 adjacent to the plug portion 111. Therefore, a part of the engaging groove 113 is located in the opening 210 of the housing 200, the other part of the engaging groove 113 is located at a side of the housing 200 away from the plug portion 111, when the engaging portion 112 passes through the opening 210. In the embodiment, the engaging groove 113 is substantially C shaped, recessed from a part of sidewalls of the engaging portion 112. In other embodiments, the engaging groove 113 recessed from entire sidewall of the engaging portion 112. An area of a cross-section of the plug portion 111 is larger than an area of the opening 210 and an area of the engaging portion 112.

The gasket 120 disposed on the engaging portion 112 and located between the plug portion 111 and the housing 200. The gasket 120 defines a through-hole 121 to make the engaging portion 112 pass through. An area of the through-hole 121 is slightly larger than a cross-section area of the engaging portion 112. In the embodiment, the gasket 120 is elastic and made of a waterproof material.

The securing member 130A is partly engaged in the engaging groove 113, and is sandwiched between the engaging portion 112 and the housing 200, to fix the main body 110 to the housing 200. The securing member 130A includes a base portion131 and two arms 132 extending from the base portion131. The two arms 132 are extending from the same side of the base portion131 and parallel to each other. In the embodiment, the base portion 131 and two arms 132 are substantially rectangular block shaped, and an inclined surface 1321 is disposed on each of the arm 132 away from the base portion 131. The securing member 130A is elastic and made of a rubber material. A gap of the engaging groove 113 exposed out of the housing 200 is less than the thickness of the securing member 130A. In other embodiments, the securing member 130A is substantially semicircular block shaped.

Figure 2:
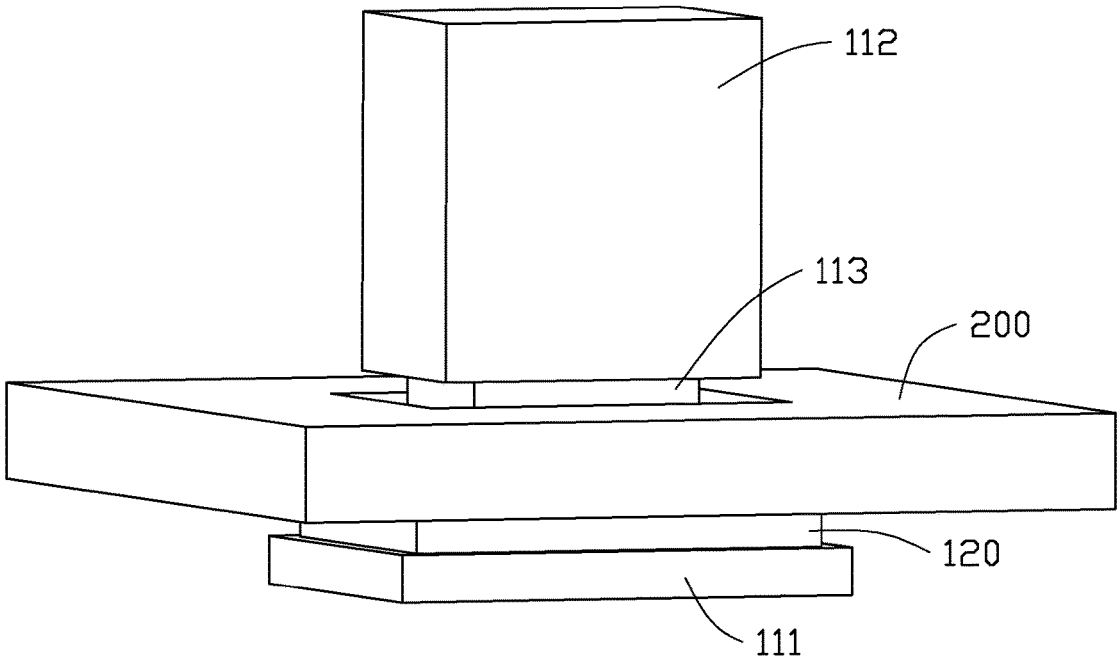
FIG. 2 is an assembled isometric view of the electronic device of FIG. 1.
Figure 3:
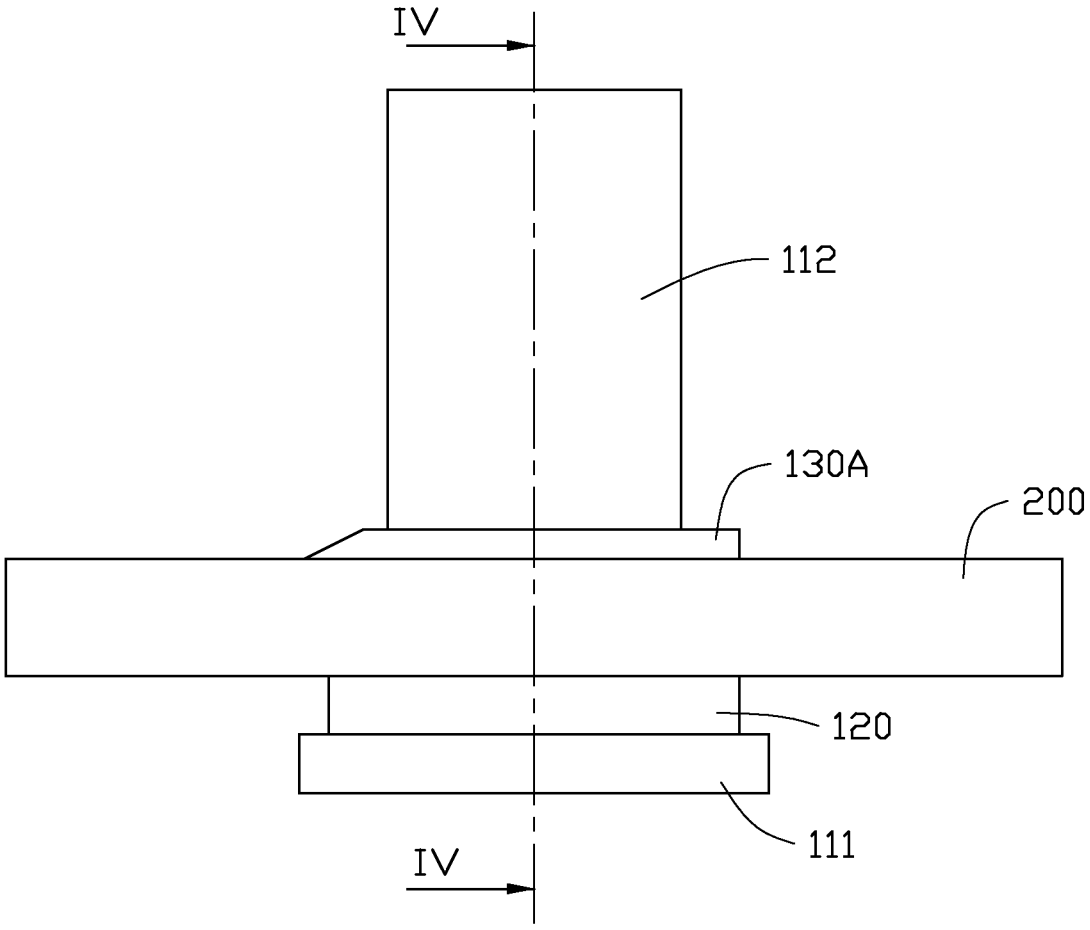
FIG. 3 is a diagrammatic view of the electronic device of FIG. 1.
Figure 4:
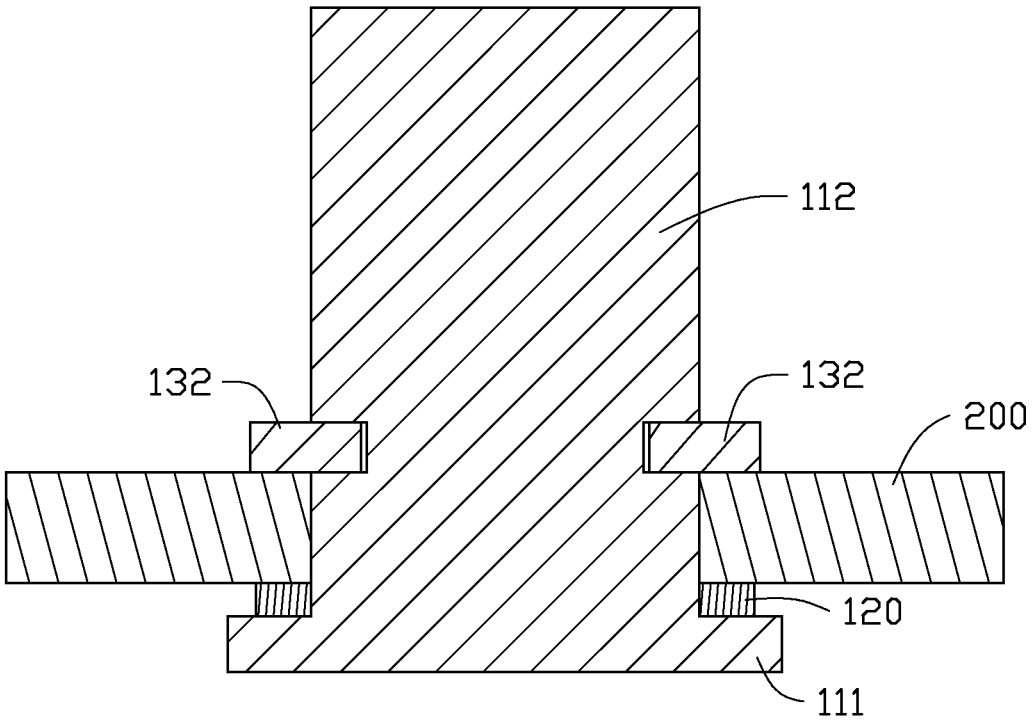
FIG. 4 is a cross-sectional view of the electronic device of FIG. 3 along IV-IV.

Referring to FIGS. 2-4, in assembly, the engaging portion 112 sequentially passes through the through-hole 121 and the opening 210, thus, a part of the engaging groove 113 away from the plug portion 111 exposed out of the housing 200. When the securing member 130A is inserted into the engaging groove 113, a force will be applied to the housing to press the gasket 120 since the gap of the engaging groove 113 exposed out of the housing is less than the thickness of the securing member 130A. Therefore, the main body 110 is tightly fixed in the opening 210. Furthermore, since the inclined surface 1321 is disposed on each of the arm 132 away from the base portion 131, even though the gap of the engaging groove 113 exposed out of the housing is less than the thickness of the securing member 130A, the securing member 130A is still easily inserted into the engaging groove 113 from the inclined surfaces 1321.

Figure 5:
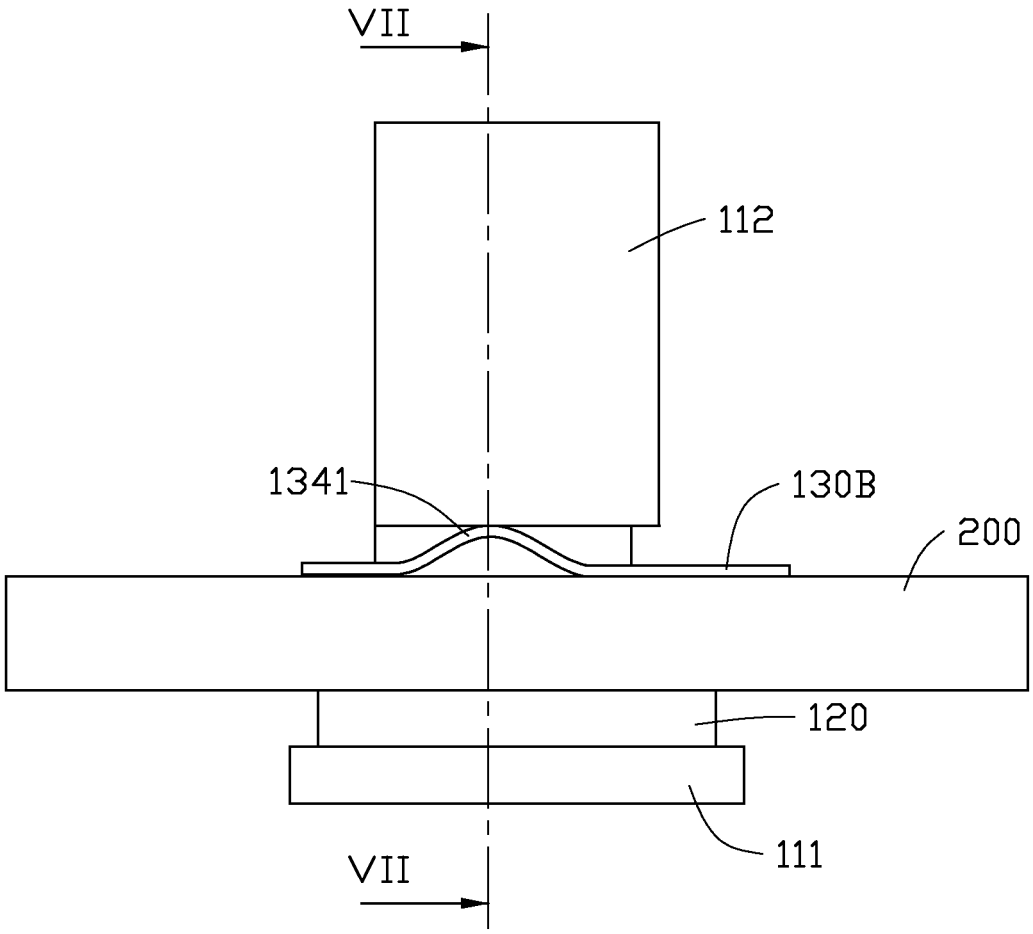
FIG. 5 is a diagrammatic view of another embodiment of an electronic device.
Figure 6:
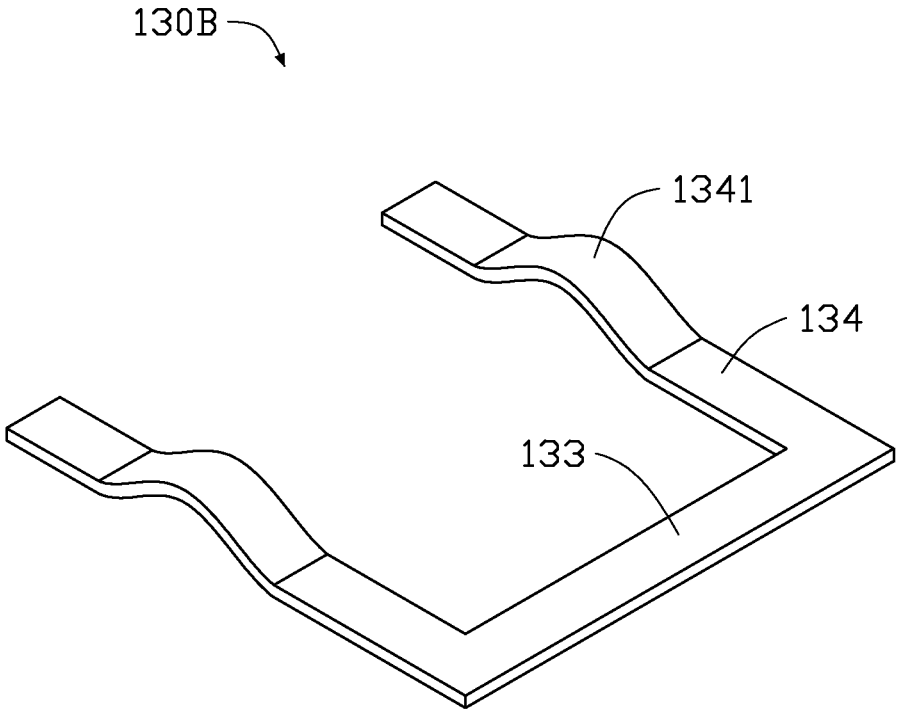
FIG. 6 is an isometric view of a securing member of FIG. 5.

Referring to FIGS. 5-6, in another embodiment, a securing member 130B is provided. The securing member 130B includes a base portion133 and two arms 134 extending from the base portion133. The two arms 134 are extending from the same side of the base portion133 and parallel to each other. A projecting portion 1341 is formed on each arm by the arm partly bend upwardly. In the embodiment, the securing member 130B is made of a metallic material. A gap of the engaging groove 113 exposed out of the housing is less than the height of the projecting portion 1341.

Figure 7:
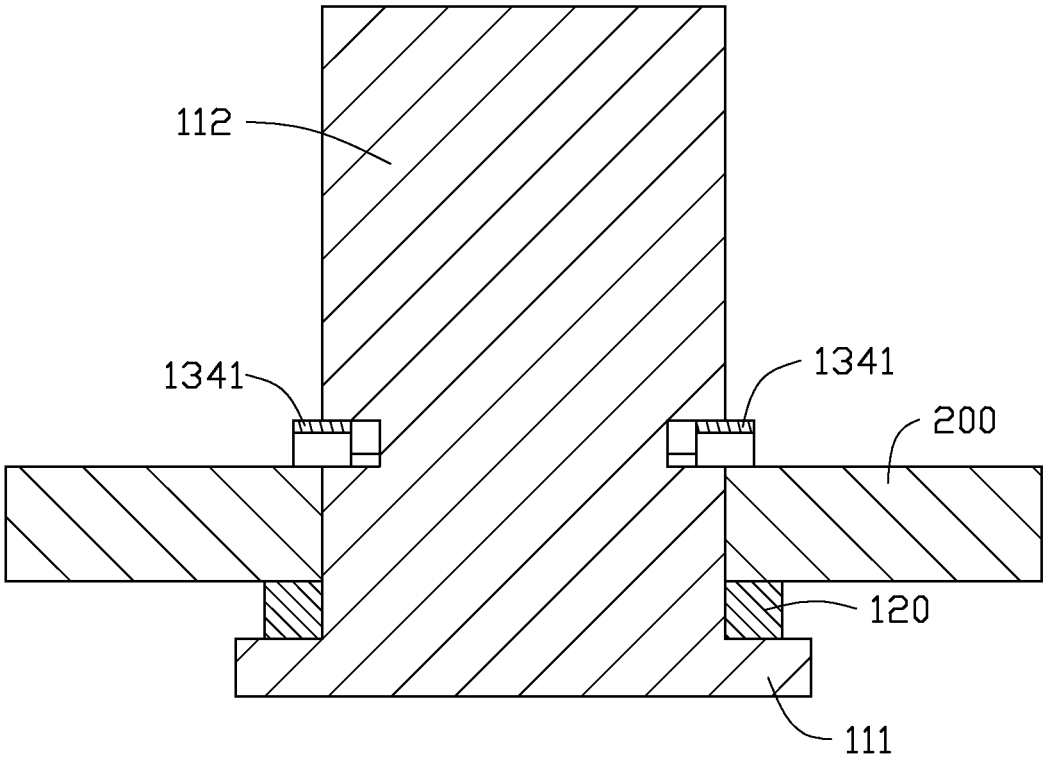
FIG. 7 is cross-sectional view of the electronic device of FIG. 5 along VII-VII.

Referring to FIG.7 again, in assembly, the engaging portion 112 sequentially passes through the through-hole 121 and the opening 210, thus, a part of the engaging groove 113 exposed out of the housing 200. When the securing member 130B is inserted into the engaging groove 113, the projecting portion 1341 deforms and an elastic force will be applied to the housing to press the gasket 120 since the gap of the engaging groove 113 exposed out of the housing is less than the height of the projecting portion 1341. Therefore, the main body 110 is tightly fixed in the opening 210.

In the two embodiments, the gap between the connector 100 and the housing 200 is filled by the gasket 120, and the gasket 120 is made of a waterproof material, that the liquid (e.g, water) is prevented from into the electronic device 300.

The embodiments shown and described above are only examples. Even though numerous characteristics and advantages of the present technology have been set forth in the foregoing description, together with details of the structure and function of the present disclosure, the disclosure is illustrative only, and changes can be made in the detail, including matters of shape, size, and arrangement of the parts within the principles of the present disclosure, up to and including the full extent established by the broad general meaning of the terms used in the claims.

What is claimed is:

1. A connector fixed in an opening of a housing of an electronic device, the connector comprising:

a main body housed in the opening, the main body comprises a plug portion, an engaging portion connected to the plug portion and forming an engaging groove adjacent to the plug portion;

a gasket located between the plug portion and the housing; and a securing member configured for fixing the main body to the housing, the securing member comprising a base portion and two arms extending from the base portion, the two arms are partly engaged in the engaging groove;

wherein the engaging portion sequentially passes through the gasket and the opening to make a part of the engaging groove away from the plug portion is located a side of the housing and the securing member partly engaged in the engaging groove and sandwiched between the engaging portion and the housing to fix the main body to the housing.

2. The connector of claim 1, wherein the gasket is elastic and made of a waterproof material.

3. The connector of claim 1, wherein the engaging groove recessed from part sidewall of the engaging portion.

4. The connector of claim 1, wherein a gap of the engaging groove exposed out of the housing is less than the thickness of the securing member.

5. The connector of claim 1, wherein the two arms are extending from the same side of the base portion and parallel to each other.

6. The connector of claim 5, wherein an inclined surface is disposed on each of the arm away from the base portion.

7. The connector of claim 6, wherein the securing member is elastic and made of a rubber material.

8. The connector of claim 1, wherein a projecting portion is formed on each arm by the arm engaged in the engaging groove partly bend upwardly.

9. The connector of claim 8, wherein the securing member is elastic and made of a metallic material.

10. An electronic device comprising:

a housing defining a opening;

a main body housed in the opening, the main body comprises a plug portion, an engaging portion connected to the plug portion and forming an engaging groove adjacent to the plug portion;

a gasket located between the plug portion and the housing; and a securing member configured for fixing the main body to the housing, the securing member comprising a base portion and two arms extending from the base portion, the two arms are partly engaged in the engaging groove;

wherein the engaging portion sequentially passes through the gasket and the opening to make a part of the engaging groove away from the plug portion exposed out of the housing and the securing member partly engaged in the engaging groove and sandwiched between the engaging portion and the housing to fix the main body to the housing.

11. The electronic device of claim 10, wherein the gasket is elastic and made of a waterproof material.

12. The electronic device of claim 10, wherein the engaging groove recessed from part sidewall of the engaging portion.

13. The electronic device of claim 10, wherein a gap of the engaging groove exposed out of the housing is less than the thickness of the securing member.

14. The electronic device of claim 10, wherein the two arms are extending from the same side of the base portion and parallel to each other.

15. The electronic device of claim 14, wherein an inclined surface is disposed on each of the arm away from the base portion.

16. The electronic device of claim 15, wherein the securing member is elastic and made of a rubber material.

17. The electronic device of claim 10, wherein a projecting portion is formed on each arm engaged in the engaging groove by the arm partly bend upwardly.

18. The electronic device of claim 17, wherein the securing member is elastic and made of a metallic material.

* * * * *